US011083942B2

(12) United States Patent
Berg et al.

(10) Patent No.: US 11,083,942 B2
(45) Date of Patent: Aug. 10, 2021

(54) FLAG RELEASE SYSTEM AND METHOD

(71) Applicant: DB3, LLC, Cedar Park, TX (US)

(72) Inventors: David W. Berg, Leander, TX (US); Brian M. Brown, Leander, TX (US)

(73) Assignee: DB3, LLC

( * ) Notice: Subject to any disclaimer, the term of this patent is extended or adjusted under 35 U.S.C. 154(b) by 0 days.

(21) Appl. No.: 16/441,638

(22) Filed: Jun. 14, 2019

(65) Prior Publication Data

US 2020/0114234 A1 Apr. 16, 2020

Related U.S. Application Data

(60) Provisional application No. 62/744,971, filed on Oct. 12, 2018.

(51) Int. Cl.
*A63B 71/00* (2006.01)
*A63B 67/00* (2006.01)

(52) U.S. Cl.
CPC ..... *A63B 67/00* (2013.01); *A63B 2243/007* (2013.01)

(58) Field of Classification Search
CPC . A63B 67/00; A63B 2243/007; A63B 67/002; A63B 71/06; A41F 9/002
USPC ..... 473/502, 470, 571; D2/627–639
See application file for complete search history.

(56) References Cited

U.S. PATENT DOCUMENTS 2,966,356 A 12/1960 Wilson
2,986,396 A * 5/1961 Abbott ..... A63B 67/00 473/502
3,251,109 A 5/1966 Wilson et al.
3,579,745 A 5/1971 Wilson
4,304,403 A 12/1981 Wilson
D302,874 S * 8/1989 Bossart ..... D21/805
5,261,756 A 11/1993 Kohn
5,456,462 A 10/1995 Wilson
6,226,844 B1 * 5/2001 Lerra ..... A44B 11/006 24/615
6,241,631 B1 6/2001 Wilson
D473,034 S * 4/2003 Styne ..... D2/624
6,728,999 B2 * 5/2004 Murai ..... A44B 11/266 24/614
2020/0114234 A1 * 4/2020 Berg ..... A63B 71/0605 473/502

* cited by examiner

*Primary Examiner* — Mitra Aryanpour
(74) *Attorney, Agent, or Firm* — The Law Firm of H. Dale Langley, Jr., PC

(57) ABSTRACT

A flag tag system for removable mating with a resilient cylindrical cup-shaped member defining a socket includes a flag retention frame connected to the flag, a post connected to the flag retention frame, and a plurality of discs or arms connected to the post, the plurality of discs or arms for mating with the socket. The flag tag system is for a flag football or similar tag game using a flag that is pulled by force to tag a player. A first device with the shaped member defining the socket is worn on a belt by the player. The plurality of discs or arms mates by pressing into the socket of the shaped member. The flag retention frame carries a flag. The plurality of discs or arms can provide select pull or force tension for grabbing the flag and thereby popping the discs or arms from engagement with the socket of the shaped member. Embodiments also include a buckle system of a plug with arms for snug connection to a socket.

11 Claims, 7 Drawing Sheets

FLAG RELEASE SYSTEM AND METHOD

CROSS-REFERENCE TO RELATED APPLICATIONS

The present application is related to, incorporates herein by reference, and has benefit of priority of U.S. Provisional Patent Application No. 62/744,971 titled "SHRUUMZ Flag Release System," filed Oct. 12, 2018, which has at least one same inventor of the present application.

TECHNICAL FIELD

The invention generally relates to a flag or tag device, and more particularly relates to a coupling and detachment device for removably securing a flag to a belt.

BACKGROUND

Flag football and other flag tag games are popular. Conventional flag release mechanisms tend to loosen, stretch out and are too easy to pull. These conventional flag release mechanisms have tended to certain designs. An objective of the flag release mechanisms should be consistency, so that each flag release operates substantially the same. The conventional designs for these flag release mechanisms have not provided this consistency.

The designs typically include a belt. A first securement device is fixed to the belt. A second securement device is fixedly coupled to a flag. The flag may be a streamer length of cloth, plastic or similar flag device. In the designs, the first securement device is retained to the belt and the second securement device removably couples with the first securement device to attach the flag with the belt.

The conventional designs have been problematic. Manufacture limitations of conventional designs result in different coupling forces of the flag to the belt. Therefore, there are differences in couple force for each individual flag that a player may carry. Players often have multiple flags in play, and certain flags may be more easily removed/grabbed than others. Moreover, these differences in couple force are more pronounced when there are multiple players. The couple force of any particular flag for one player can differ from the couple force of flags of another player.

Moreover, the conventional designs have tendency to wear. A common type of first securement device is a loop with attached pliable socket. A belt is fed through the loop to retain the first securement device to the player. A common type of second securement device includes a single solid plug of cylindrical shape substantially conforming to the socket walls. The socket of the first securement device removably couples with the plug of the second securement device to engage the flag to the player. The socket, typically made of a rubber or plastic, can stretch and loosen because of the solid plug of same shape as the socket. This results in more easy or ready removal of the plug from engagement with the socket. As a consequence, there is not consistency of removal force for different flags.

In addition to consistency, it has been desirable that flag removal causes a sound, such as a pop, when the flag is tugged with sufficient force for removal. The conventional designs have included second securement devices of form of a solid ball, plug, or similar. With a ball of the second securement device, the socket conforms to the outside of the ball. The socket can stretch out and loosen with repeated use. Sockets also tend to stretch out and loosen when used with conventional plugs. The socket for these plugs has generally been shaped as a cylinder, and the plug has been solid and cylindrical in shape to conform to the cylinder of the socket. The plug is retained to the socket by friction. As sockets wear, both ball and plug conventionally become more easily removable from the socket and sound created by removal is diminished.

It would, therefore, be a significant improvement in the art and technology to provide improved flag release systems and methods.

SUMMARY

An embodiment of the invention includes a flag release system for coupling with a resilient cup-shaped member defining a socket. The system includes a flag retention frame connected to the flag, a post connected to the flag retention frame, and a plurality of discs connected to the post, the plurality of discs for mating with the socket.

Another embodiment of the invention is a method of manufacture of a flag release system. The method includes forming a post, forming a flag retention frame connected to an end of the post, and forming a plurality of discs on the post.

Yet another embodiment of the invention is a system that includes a socket of generally geometric cross-section shape, a belt retainer connected to the socket, a post, a flag retention frame connected to an end of the post, and a plurality of discs or arms on the post opposite the end of the post. The plurality of discs or arms, when plugged into the socket, create a desired pull tension required to expel the discs or arms from the socket.

Another embodiment of the invention is a system that includes a socket forming a hole of generally geometric cross-section shape, and a plug formed with a plurality of arms sized to snugly conform to the hole of the socket.

Yet another embodiment of the invention is a method of manufacture of a buckle system. The method includes forming a socket with a generally geometric cross-section hole and forming a plug with a plurality of arms sized to snugly conform to the hole when the plug is engaged to the socket.

BRIEF DESCRIPTION OF THE DRAWINGS

The present invention is illustrated by way of example and not limitation in the accompanying figures, in which like references indicate similar elements, and in which.

DETAILED DESCRIPTION

Figure 1:
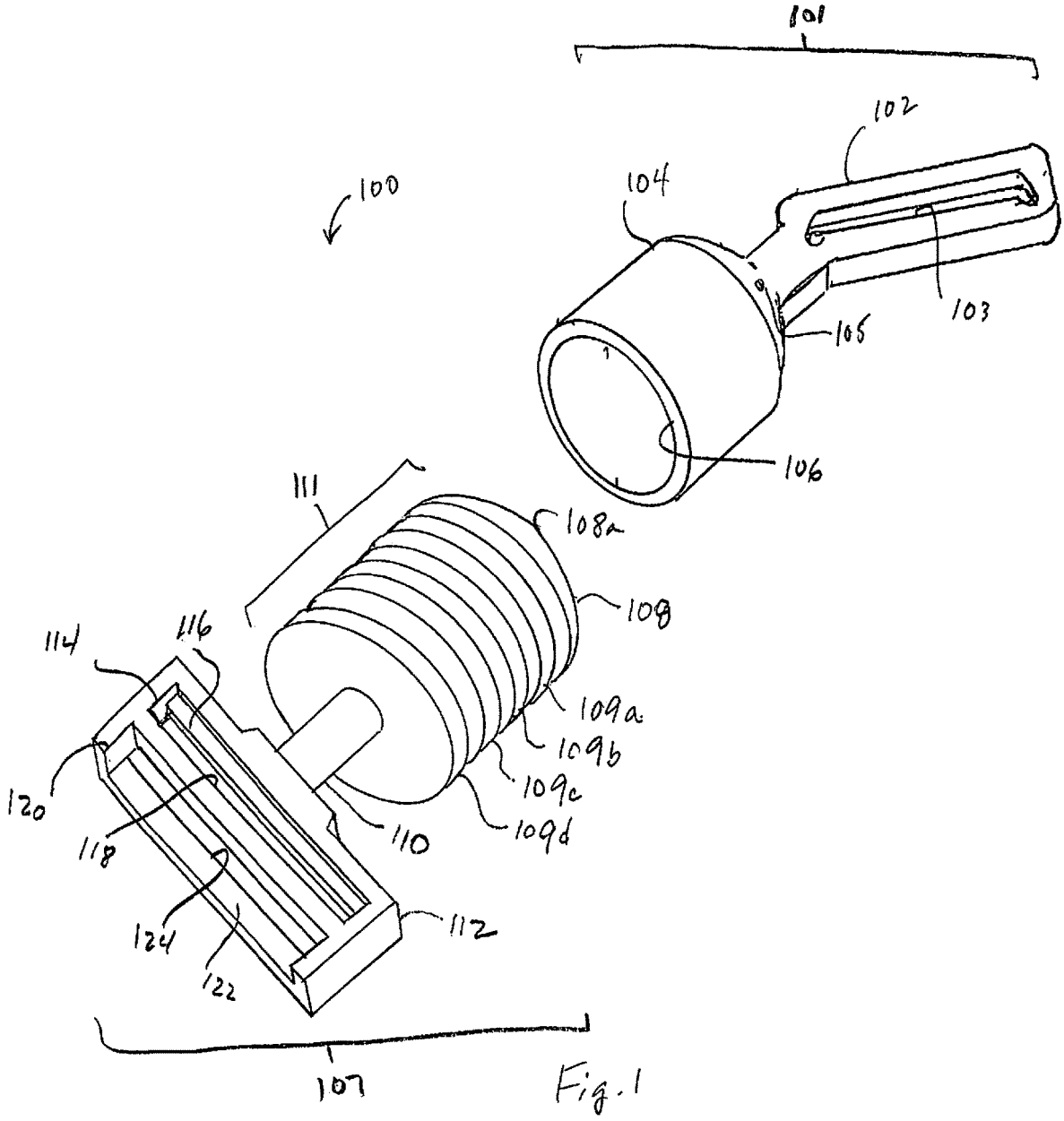
FIG. 1 illustrates a front perspective view of a system for a flag or tag game, including a first securement device and a second securement device with a series of discs or arms for plug into the first securement device, according to certain embodiments of the invention.
Figure 2:
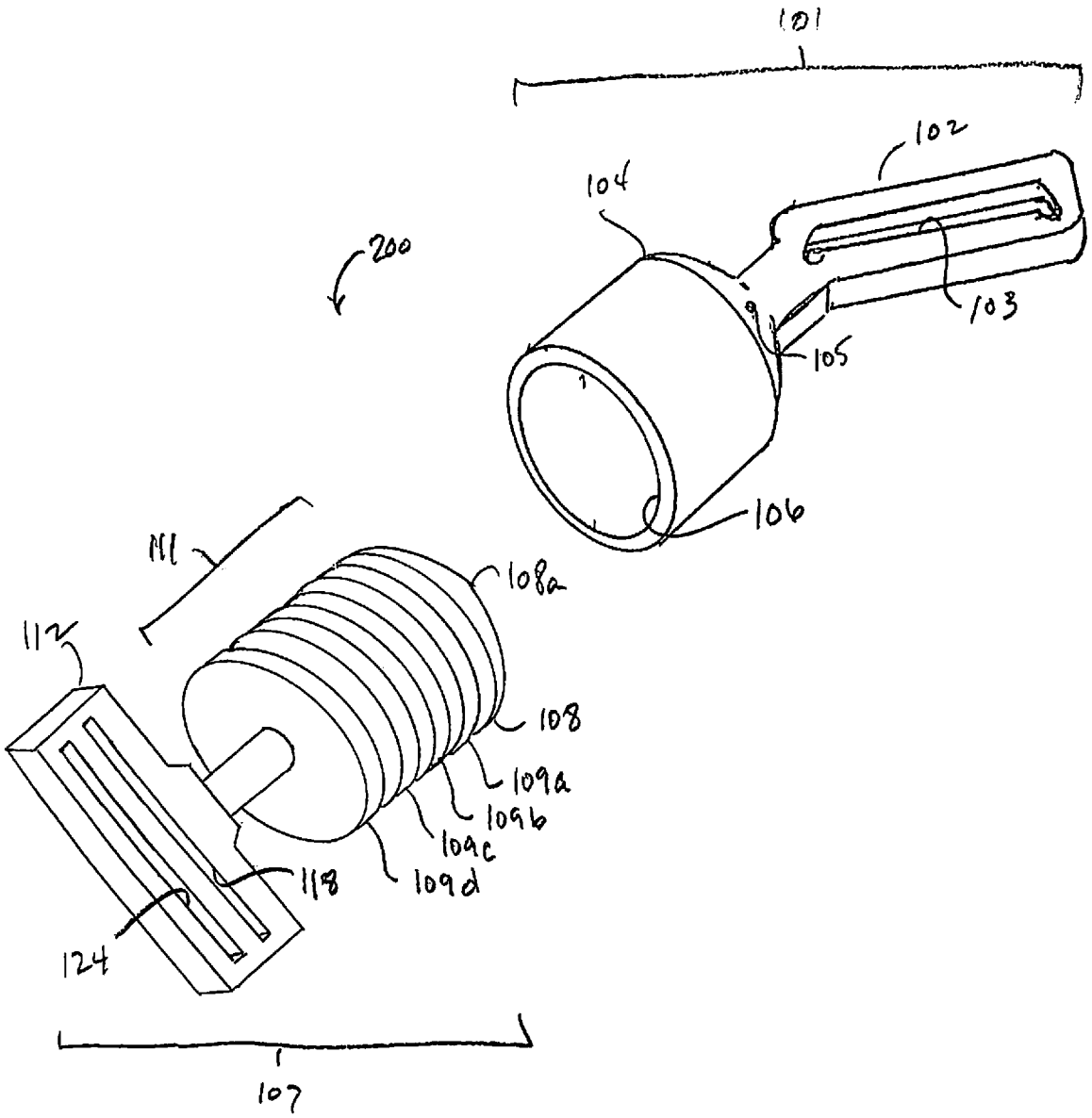
FIG. 2 illustrates a front perspective view of the first securement device and a back perspective view of the second securement device of FIG. 1, according to certain embodiments of the invention.

Referring to FIGS. 1 and 2, in conjunction, a system 100, 200 includes a first securement device 101 of a belt loop 102 connected to a socket 104. The belt loop 102 is sized and configured to pass a belt (shown in FIGS. 8 and 9) through a belt hole 103 in order to retain the device 101 to the belt. The socket 104 is a cylinder or other geometric cross-sectional hole 106 formed of desired size to house a second securement device 107 as will be described. An end of the socket 104 adjacent the belt loop 102 includes a hole 105.

Figure 3:
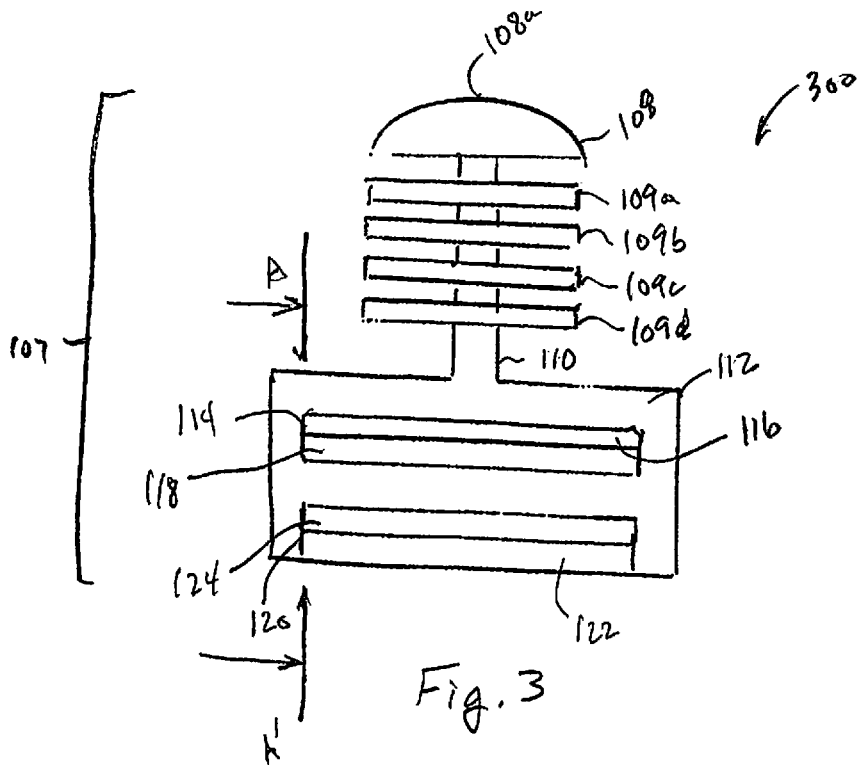
FIG. 3 illustrates a front view of the second securement device of FIGS. 1 and 2, according to certain embodiments of the invention.
Figure 4:
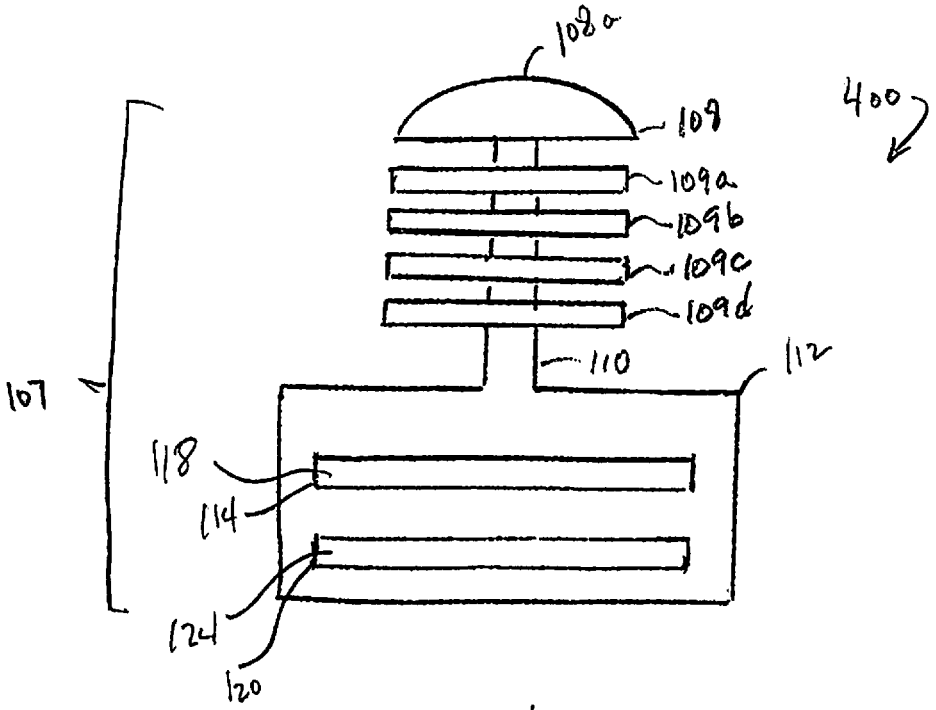
FIG. 4 illustrates a back view of the second securement device of FIGS. 1 and 2, according to certain embodiments of the invention.
Figure 5:
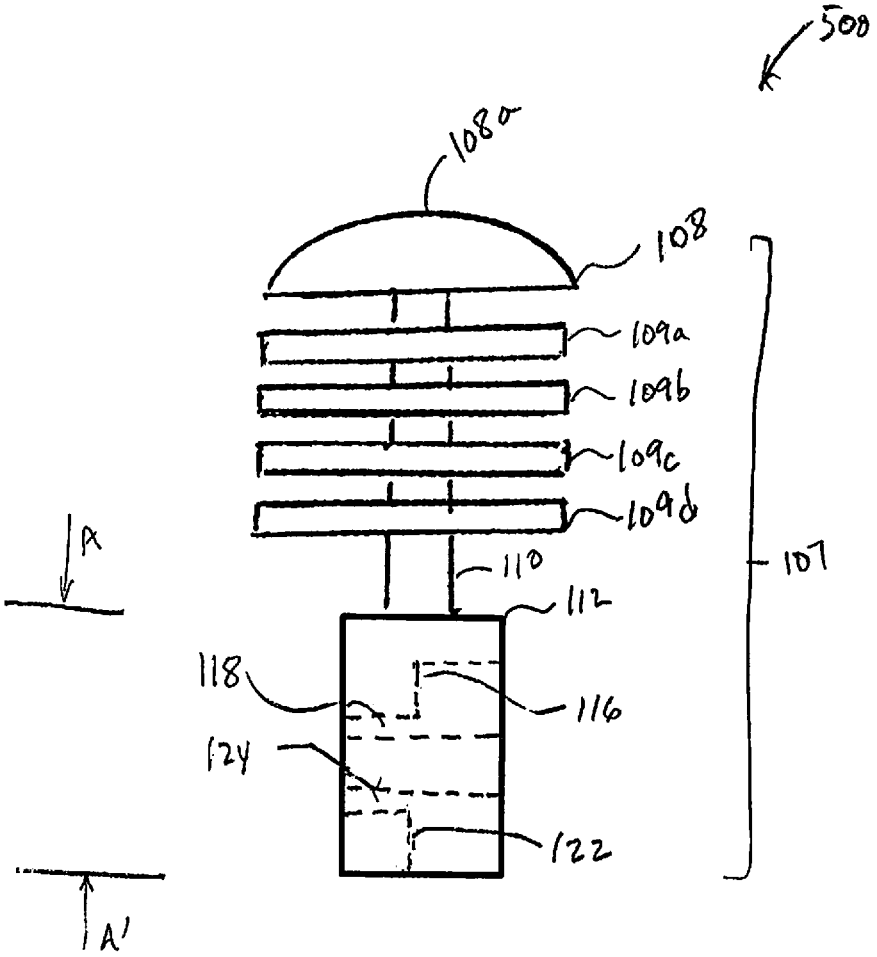
FIG. 5 illustrates a left side view of the second securement device of FIGS. 1 and 2, according to certain embodiments of the invention.

The second securement device 107 includes a generally cylindrical or other geometric shape (as applicable) arrangement of multiple discs 108, 109*a-d*, connected to each other by a central post 110 (shown in FIGS. 3-5). The central post 110 extends beyond a last disc 109*d* to connect to a flag retention frame 112. The disc 108 may be formed with a somewhat rounded or elliptical forward extent 108*a* directed away from the other discs 109*a-d*.

Each of the discs 108, 109*a-d* is connected in series by the post 110. The post 110 is centrally connected to each of the discs 108, 109*a-d*. In embodiments, the discs 108, 109*a-d* may be of substantially same cylindrical or geometric cross-sectional size or different in size, depending on desired configuration. In any event, cylindrical or other cross-sectional size of the discs 108, 109*a-d* is such that the discs 108, 109*a-d* form a plug 111 that may be lodged within the hole 106 of the socket 104 in snug manner.

The post 110 extends from the disc 109*d* to connect to a frame 112. The frame 112 includes parallel features 116, 122 connected to sides 114, 120, respectively, of the frame 112. The parallel features 116, 122 form parallel flag slits 118, 124, respectively. The parallel features 116, 122 accept a streamer flag (shown in FIGS. 8 and 9) through the parallel flag slits 118, 124.

In operation, the first securement device 101 is connected by the belt hole 103 of the belt loop 102 to a belt. The belt is for wear around the waist by a flag or tag game player. The second securement device 107 is connected by the parallel flag slits 118, 124 of the parallel features 116, 122 to a streamer or flag. The plug 111 formed of the discs 108, 109*a-d* is forced into the cylinder 106 of the socket 104. In play, a player grabs the flag with sufficient force to overcome friction and suction of the plug 111 with the socket 104. When quick force is applied to grab the flag, the plug 111 exits the socket 104 with a substantial pop sound.

In certain embodiments, the first securement device 101 is formed of plastic, rubber, composite or other material that is not readily deformed through expansion or stretching. The second securement device 107 is formed of plastic, rubber, composite or other material sufficient to create friction and suction when the second securement device 102 is plugged into the first securement device 101 and when quickly forced from that engagement.

Although the discs 108, 109*a-d* are illustrated for purposes of example, the number, sequence, size, width, material, arrangement, geometric shape and other configuration of discs may be varied. For example, more or fewer discs may be desirable such as to vary the force required to disengage the second securement device 107 from the first securement device 101. Younger youth, teens, and adults may have different gradations of desired force requirements for grabbing a flag retained by the system 100, 200. If lesser or greater force is desired for disengagement of the second securement device 107 from the first securement device 101, additional discs, discs of greater width, structurally more rigid discs, discs of particular material, and other variations of discs and among discs are possible. Even more, the shape of the plug and discs may be varied, such as triangular, square, hexagonal or other shape in cross-section.

Continuing to refer to FIGS. 1 and 2, the figures illustrate two opposing sides of the second securement device 107. The side in FIG. 1 illustrates the parallel features 116, 122 as inset ledges of the frame 112. The side in FIG. 2 illustrates that the parallel features 116, 122 (not shown in detail) are formed flush with the outer side surface of the second securement device 107. The parallel flag slits 118, 124 for receiving and retaining a streamer or flag are shown in both figures.

Referring to FIG. 3, a system 300 illustrates a front side view of the second securement device 107 for use with a first securement device 101 (shown in FIGS. 1, 2, 8, and 9). The second securement device 107 includes the discs 108, 109*a-d*, connected in sequence by the post 110. The disc 108 includes a generally rounded or elliptical end 108*a*. The discs 109*a-d* are uniform in circular (or other geometric shape) as well as thickness size, although any other configuration, shape and sizing of discs is possible depending on application.

The post 110 connects opposite the discs 108, 109*a-d*, to the frame 112. The frame 112 is generally rectangular in overall shape and is sized to extend laterally beyond a width of a flag or streamer (shown in FIGS. 8 and 9) for attachment thereto. The frame 112 forms the sides 114, 120, respectively. The sides 114, 120 connect to the parallel features 116, 122. The parallel features 116, 122 and the sides 114, 120 form parallel flag slits 118, 124, respectively. The parallel flag slits 118, 124 accept a streamer flag (shown in FIGS. 8 and 9) through the parallel flag slits 118, 124.

Referring to FIG. 4, a system 400 illustrates a back side view of the second securement device 107. The discs 108, 109*a-d* are connected by the post 110. The disc 108 includes rounded end 108*a*. Opposing the discs 108, 109*a-d*, the post 110 extends to connect to the frame 112. The frame 112 includes sidewalls 114, 120 that form the parallel flag slits 118, 124.

Referring to FIG. 5, a system 500 illustrates an end view of the second securement device 107. The system 500 includes the discs 108, 109*a-d* connected by the post 110 in series. The disc 108 includes a rounded end 108*a* for ease of insertion of the second securement device 107 into the socket 104 of the first securement device 101 (shown in FIGS. 1, 2, 8 and 9). The post 110 extends opposite the disc 109*d* to connect to the frame 112. The frame 112 is generally rectangular at the end. The frame 112 includes (as shown in phantom) the parallel features 116, 122. The parallel features 116, 122, together with the sides 114, 120 (not shown in FIG. 5), form the parallel flag slits 118, 124 extending from front to back of the device 107.

Figure 6:
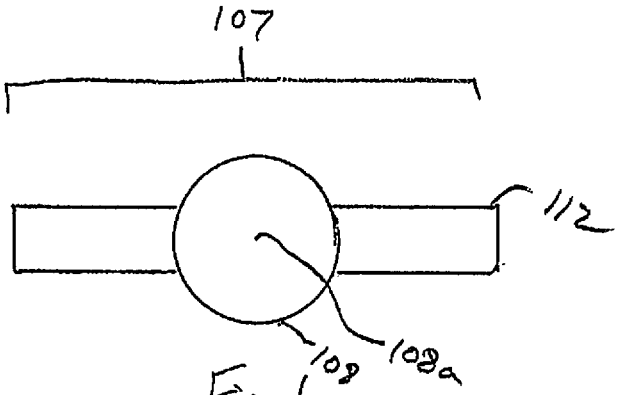
FIG. 6 illustrates a top view of the second securement device of FIGS. 1 and 2, according to certain embodiments of the invention.

Referring to FIG. 6, a system 600 illustrates a top view of the second securement device 107. The disc 108, together with the other discs 109*a-d* (not shown), connect by the post 110 (not shown) to the frame 112. The disc 108 has the rounded end 108*a* extending on the outer surface of the disc 108.

Figure 7:
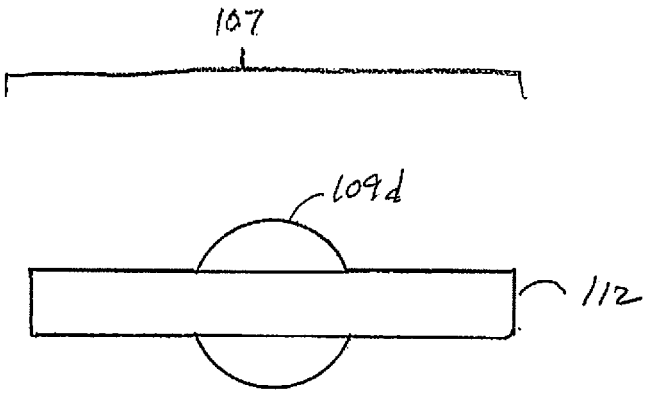
FIG. 7 illustrates a bottom view of the second securement device of FIGS. 1 and 2, according to certain embodiments of the invention.

Referring to FIG. 7, a system 700 illustrates a bottom view of the second securement device 107. The frame 112 connects to the disc 109*d*, as well as the other discs 108, 109*a-c* (not shown) by the post 110 (not shown).

Figure 8:
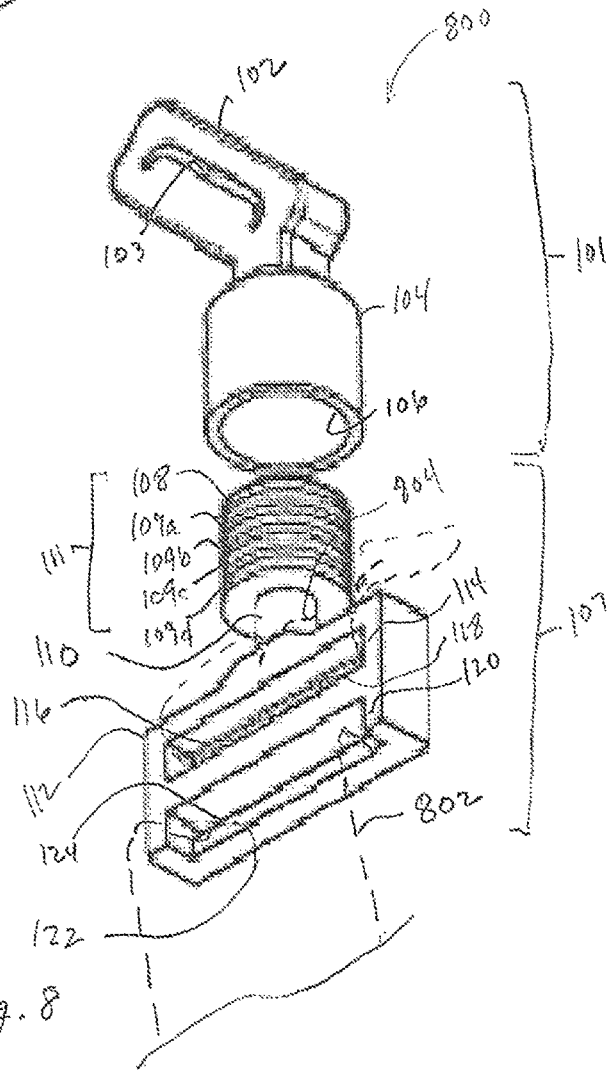
FIG. 8 illustrates a front perspective view of the first securement device and the second securement device of FIGS. 1 and 2, with a flag (in phantom) connected to the second securement device and discs of the second securement device disengaged from the first securement device, according to certain embodiments of the invention.
Figure 10:
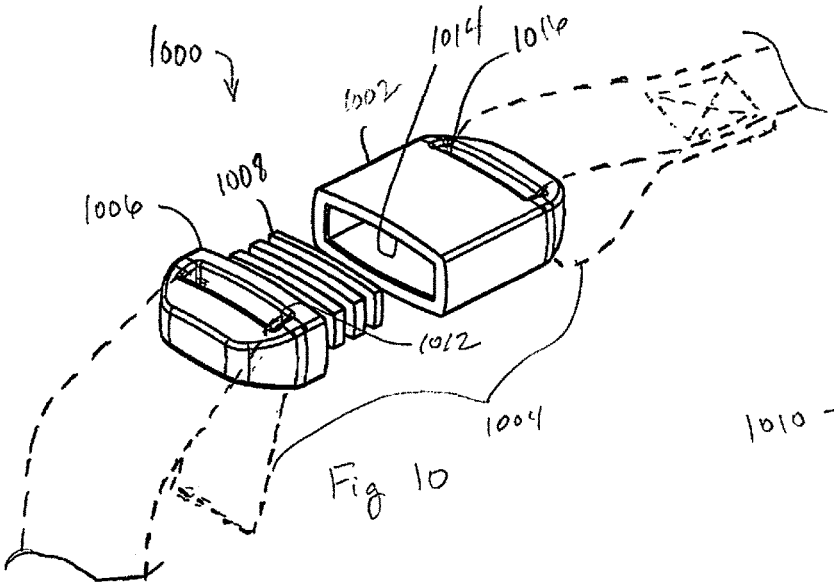
FIG. 10 illustrates a front perspective view of a plug and socket for use as a buckle of a belt (shown in phantom), the belt may connect to one or more flags (not shown), according to certain embodiments of the invention.

Referring to FIG. 8, a system 800 includes a flag 802 (shown in phantom) connected to the second securement device 107 and removed from connection to the first securement device 101. The second securement device 107 includes the discs 108, 109*a-d* connected by the post 110. The post 110 connects to the frame 112. The frame 112 forms the parallel flag slits 118, 124. The parallel features 116, 122 of the frame 112, together with the sides 114, 120 of the frame 112, define the parallel flag slits 118, 124. The flag 802 includes a slit 804 or other feature to accept the post 110 therethrough, and an opposing end of the flag 802.

Figure 9:
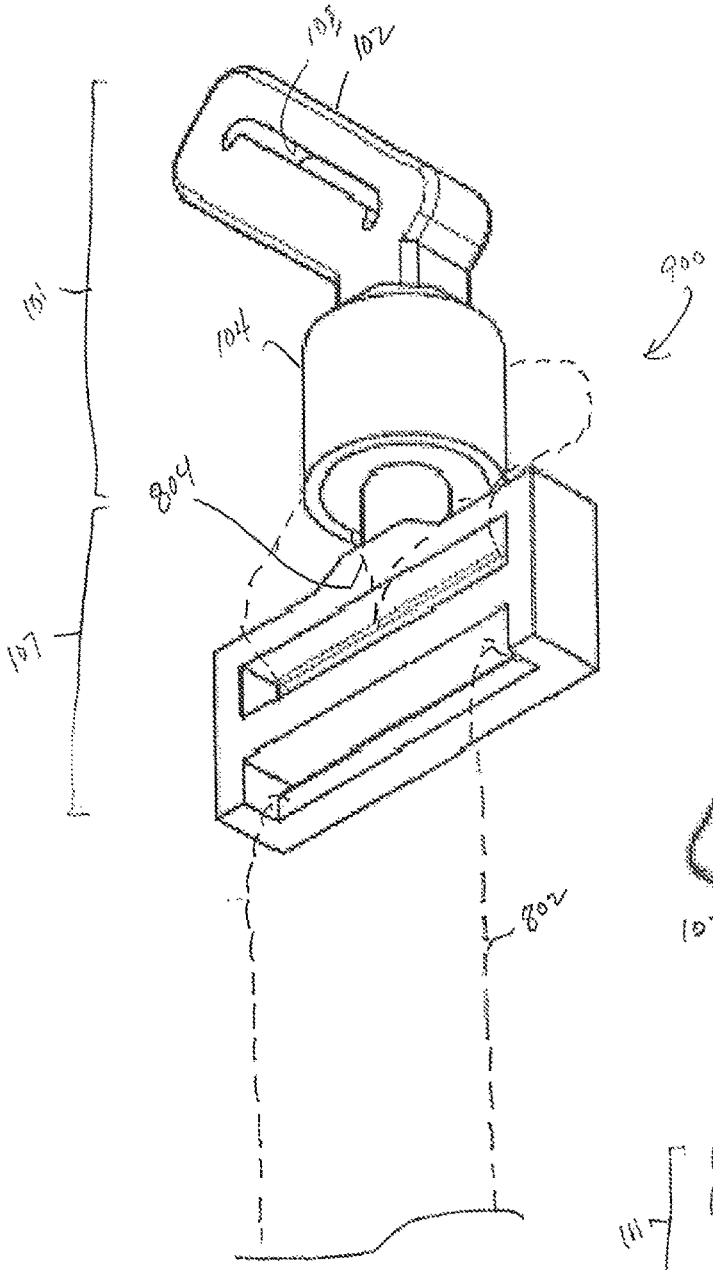
FIG. 9 illustrates a front perspective view of the first securement device and the second securement device of FIGS. 1 and 2, with a flag (in phantom) connected to the second securement device and discs of the second securement device plugged into the first securement device, according to certain embodiments of the invention.

Referring to FIG. 9, a system 900 includes the second securement device 107 engaged by the plug 111 (not shown) in the socket 104 of the first securement device 101. The first securement device 101, as non-exclusive example, forms an angle between the belt loop 102 and the socket 104. When the second securement device 107 is so plugged into the first securement device 101, the flag 802 can dangle a small distance from a player wearing a belt connected through the belt loop 103.

In operation, a belt is passed through the loop 103 of the belt loop 102 of the first securement device 101. The post 110 of the second securement device 107 is placed through the slit 804 of the flag 802. The opposing end of the flag 802 is passed into the parallel flag slit 118 and reversed back through the parallel flag slit 124. The plug 111 of the second securement device 107 is pressed into the socket 104 of the first securement device 101. A flag or tag game player wears the belt with the assembly of the first and second securement devices 101, 107. During play, the flag 802 is grabbed and forced by sufficient strength to expel the second securement device 107 from engagement with the first securement device 101.

Referring to FIGS. 10-13, in conjunction, a system 1000, 1100, 1200, 1300 includes a securement socket 1002 of a belt 1004 (shown in phantom) engaged by a plug 1006 of the belt 1004. The securement socket 1002 and the plug 1006 operate as a buckle for the belt 1004. The belt 1004 may include attached flags or the like. For non-exclusive example, three flags may be fixedly attached to the belt 1004 or otherwise.

Figure 12:
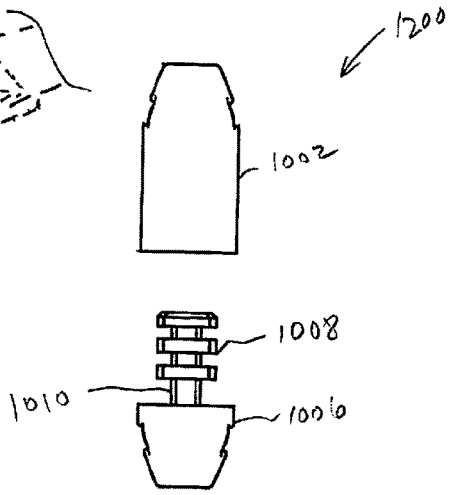
FIG. 12 illustrates a side view of the plug and socket of FIGS. 10 and 11, for use as a buckle of a belt which may connect to one or more flags, according to certain embodiments of the invention.
Figure 11:
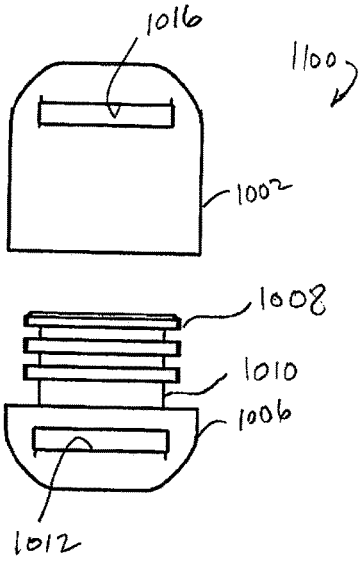
FIG. 11 illustrates a front view of the plug and socket of FIG. 10, for use as a buckle of a belt which may connect to one or more flags, according to certain embodiments of the invention.
Figure 13:
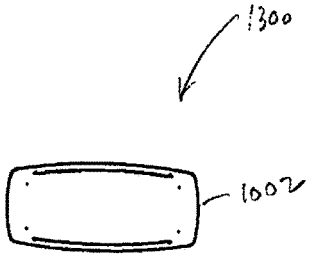
FIG. 13 illustrates an end view of the plug and socket of FIGS. 10-12, for use as a buckle of a belt which may connect to one or more flags, according to certain embodiments of the invention.

The plug 1006 includes a series of arms 1008 connected to each other by a central stem 1010 (shown in FIGS. 11-12). The central stem 1010 extends to connect to a belt retention frame 1012. Each of the arms 1008 is connected in series by the stem 1010. The stem 1010 is centrally connected to each of the arms 1003. In embodiments, the arms 1008 may be of substantially same generally rectangular or other geometric cross-section size or different in size of geometric configuration, depending on desired configuration. In any event, generally rectangular or other size of the arms 1008 is such that the arms 1008 form the plug 1006 that may be lodged within an interior hole 1014 of the socket 1002 in snug manner.

The stem 1010 extends to connect to the frame 1012. The frame 1012 may, in non-exclusive examples, include parallel features or other belt tightening and retention mechanisms. The frame 1012 accepts an end of the belt 1004 through the parallel features or other mechanisms. Alternately, the belt 1004 may adjustably or fixedly attach to the plug 1006.

The socket 1002 includes a belt loop attachment element 1016 opposite the hole 1014 of the socket 1002. The element 1016 may, as non-exclusive example, be a slit or other opening through which the belt 1004 may pass. The belt 1004 passing through the opening of the element 1016 may be sewed or otherwise fixed at the end to the socket 1002 back on the belt 1004. Alternately, the belt 1004 may be otherwise connected to the socket 1002, either fixedly or adjustably as desired. The hole 1014 of the socket 1002 may be generally rectangular in cross-section or other geometric shape cross-section, such that the plug 1006 can lodge snugly in the hole 1014. When the plug 1006 is quickly withdrawn from the hole 1014 of the socket 1002 by adequate force, a "pop" sound may be made.

In operation, the plug 1006 is connected to an end of the belt 1004. Another end of the belt 1004 is connected to the socket 1002. The belt 1004 is for wear around the waist by a flag or tag game player. The belt 1004 includes or is connected to one or more flag (not shown). The belt 1004 may be adjustable, such as for non-exclusive example, the plug 1006 may include adjustment features to extend and shorten length of the belt 1004 between the socket 1002 and the plug 1006. The plug 1006 formed of the arms 1008 is forced into the hole 1014 of the socket 1002. In play, a player grabs a flag of the belt 1004 to pull the flag and belt 1004 with sufficient force to overcome friction and suction of the plug 1006 with the socket 1002. When quick force is applied to grab the flag, the plug 1006 exits the socket 1002 with a substantial pop sound and the belt 1004 falls from the player.

Variations in the foregoing are possible. As non-exclusive example, numbers of discs or arms can be increased or decreased for greater pull resistance to disengage a flag from a player. In another non-exclusive example, materials and dimensions of discs or arms can be varied, same, or differently configured. For non-exclusive example, the shape of the plug and discs or arms, as well as the sockets, may be varied, such as triangular, square, hexagonal or other shape in cross-section, either uniform or not. Different materials of the several discs may provide greater or lesser pull resistance as desirable. Moreover, non-exclusive variations include varied materials or configuration of the socket into which the disc plug is inserted. For non-exclusive example, it may be possible to employ a more rigid socket because of the discs of the plug. Further, cross-section and other shapes of the plug and its discs or arms may be subject to wide geometric variation. In any event, non-exclusive examples of variations include configurations of discs and arms to form the plug and corresponding shape of sockets. As non-exclusive example, the plug with discs or arms, as well as other features, may be formed through molding, extrusion or other process. Similarly, the socket and related features may be formed through molding, extrusion or other process.

In the foregoing, the invention has been described with reference to specific embodiments. One of ordinary skill in the art will appreciate, however, that various modifications, substitutions, deletions, and additions can be made without departing from the scope of the invention. Accordingly, the specification and figures are to be regarded in an illustrative rather than a restrictive sense, and all such modifications substitutions, deletions, and additions are intended to be included within the scope of the invention. Any benefits, advantages, or solutions to problems that may have been described above with regard to specific embodiments, as well as device(s), connection(s), step(s) and element(s) that may cause any benefit, advantage, or solution to occur or become more pronounced, are not to be construed as a critical, required, or essential feature or element.

What is claimed is:

1. A system for use during flag football, comprising:

a socket including a hollow inner surface;

a post assembly including a post and a plurality of discs extending along a length of the post, the plurality of discs are supported on and extending away from the post, wherein the post assembly is received within the socket, wherein the plurality of discs are lodged against the inner surface of the socket when the post is inserted within the socket;

a belt retainer connected to the outer surface of the socket;

a flag retention frame connected to an end of the post opposite the plurality of discs; and wherein the post assembly, when received within the inner surface of the socket, create a pull tension required to expel the post assembly from the inner surface of the socket.

2. The system of claim 1, wherein the socket includes a hole to allow air to expel when the plurality of discs are plugged into the inner surface of the socket.

3. The system of claim 1, wherein when the post assembly is tugged and pulled from the inner surface of the socket, a pop sound is produced.

4. The system of claim 1, further comprising: a flag connected to the flag retention frame and the post.

5. The system of claim 1, wherein the inner surface of the socket is a cylinder and each of the plurality of discs are a thin disc, and the post centrally connected to each disc.

6. The system of claim 5, wherein the width of each of the plurality of discs creates sufficient pull tension through friction needed between the plurality of discs and the inner surface of the socket.

7. The system of claim 1, wherein each of the plurality of discs is shaped to create sufficient pull tension through friction between the plurality of discs and the inner surface of the socket.

8. The system of 7, wherein the post connects centrally to each of the plurality of arms and each of the plurality of arms has a width to create friction between the plurality of discs and the inner surface of the socket.

9. The system of claim 8 wherein each of the plurality of discs is formed of a pliable material creating the desired pull tension between the plurality of discs and the inner surface of the socket.

10. The system of claim 1, wherein the socket is formed of a first material and the plurality of discs are formed of a second material.

11. A method of manufacture of the system of claim 1, comprising:

molding the socket; and molding the post and the plurality of arms.

* * * * *